US009895892B2

(12) United States Patent
Yoshiike

(10) Patent No.: US 9,895,892 B2
(45) Date of Patent: Feb. 20, 2018

(54) HEAD UNIT AND LIQUID DISCHARGE APPARATUS INCLUDING SAME

(71) Applicant: Masataka Yoshiike, Kanagawa (JP)

(72) Inventor: Masataka Yoshiike, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/334,664

(22) Filed: Oct. 26, 2016

(65) Prior Publication Data

US 2017/0066266 A1 Mar. 9, 2017

(30) Foreign Application Priority Data

Nov. 18, 2015 (JP) ..... 2015-226113
Sep. 5, 2016 (JP) ..... 2016-172663

(51) Int. Cl.
*B41J 2/245* (2006.01)
*B41J 2/165* (2006.01)
*B41J 25/00* (2006.01)

(52) U.S. Cl.
CPC ..... *B41J 2/16508* (2013.01); *B41J 2/16585* (2013.01); *B41J 2/245* (2013.01); *B41J 25/001* (2013.01); *B41J 25/003* (2013.01)

(58) Field of Classification Search
CPC ... B41J 3/54; B41J 3/543; B41J 25/001; B41J 2/245; B41J 2/25; B41J 2/265; B41J 2/17503; B41J 2/2103; B41J 11/008; B41J 2202/20; B41J 2202/19
See application file for complete search history.

(56) References Cited

U.S. PATENT DOCUMENTS

2010/0156992 A1* 6/2010 Xie ..... B41J 2/155 347/49
2012/0044296 A1* 2/2012 Gouch ..... B41J 2/155 347/40
2013/0021412 A1 1/2013 Nishimura et al.
2016/0096386 A1 4/2016 Yoshiike

FOREIGN PATENT DOCUMENTS

JP 2001-113679 4/2001
JP 2006-132795 6/2008
JP 2008-296503 12/2008
JP 2012-000930 1/2012
JP 2012000930 A * 1/2012
JP 2013-022848 2/2013

* cited by examiner

*Primary Examiner* — Sharon A Polk
(74) *Attorney, Agent, or Firm* — Cooper & Dunham LLP

(57) ABSTRACT

A head unit includes a plurality of heads; and a head mount on which the plurality of heads is arrayed. The head mount includes a position adjuster to adjust a position of each of the plurality of heads, each of the plurality of heads includes cutouts at both ends of each of the plurality of heads in a head alignment direction, the cutouts of adjacent heads are opposed each other, and the position adjuster is disposed between the opposed cutouts of the adjacent heads.

10 Claims, 12 Drawing Sheets

FIRST COMPARATIVE EXAMPLE

SECOND COMPARATIVE EXAMPLE

HEAD UNIT AND LIQUID DISCHARGE APPARATUS INCLUDING SAME

CROSS-REFERENCE TO RELATED APPLICATIONS

The present application claims priority pursuant to 35 U.S.C. §119(a) from Japanese patent application numbers 2015-226113, filed on Nov. 18, 2015, and 2016-172663, filed on Sep. 5, 2016, the entire disclosure of each of which is incorporated by reference herein.

BACKGROUND

Technical Field

Exemplary embodiments of the present disclosure relate to a head unit and a liquid discharge apparatus.

Background Art

A long head unit including a plurality of short heads or head chips arrayed is known. Such a type of head unit is called a multi-array head. When the plurality of short heads is so arrayed, positional adjustment of each head is important.

SUMMARY

In one embodiment of the disclosure, provided is an optimal head unit including a plurality of heads; and a head mount on which the plurality of heads is arrayed. The head mount includes a position adjuster to adjust a position of each of the plurality of heads, each of the plurality of heads includes cutouts at both ends of each of the plurality of heads in a head alignment direction, the cutouts of adjacent heads are opposed each other, and the position adjuster is disposed between the opposed cutouts of the adjacent heads.

Further, provided is an optimal head unit including a plurality of heads; a plurality of intermediate members to hold the plurality of heads; and a head mount on which the plurality of heads is arrayed. The head mount includes a position adjuster to adjust a position of each of the plurality of heads, each of the plurality of intermediate members includes cutouts at both ends of each of the plurality of intermediate members in a head alignment direction, the cutouts of adjacent intermediate members of the plurality of intermediate members to hold adjacent heads of the plurality of heads are opposed each other, and the position adjuster is disposed between the opposed cutouts of the adjacent intermediate members.

These and other features and advantages of the present disclosure will become apparent upon consideration of the following description of embodiments of the present disclosure when taken in conjunction with the accompanying drawings.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION

Hereinafter, embodiments of the present disclosure will be described with reference to accompanying drawings.

Figure 1:
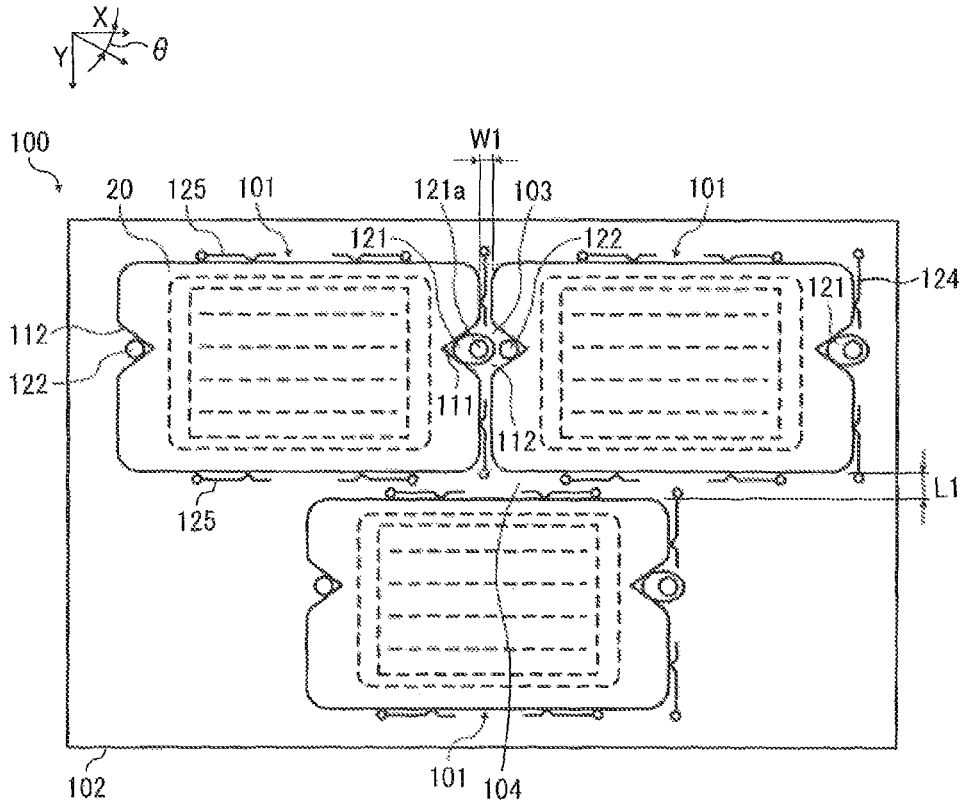
FIG. 1 schematically illustrates a head unit according to a first embodiment of the present disclosure.
Figure 2:
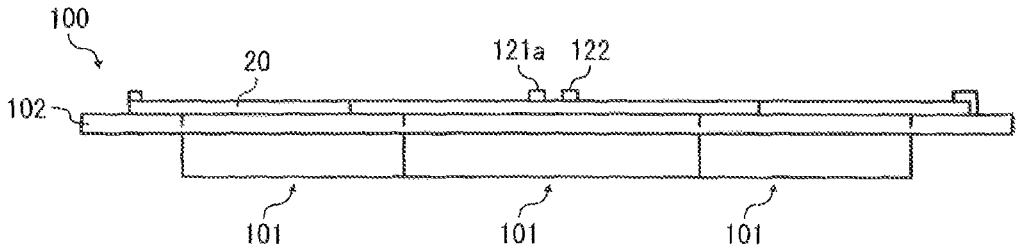
FIG. 2 is a front view of the head unit of FIG. 1.
Figure 3:
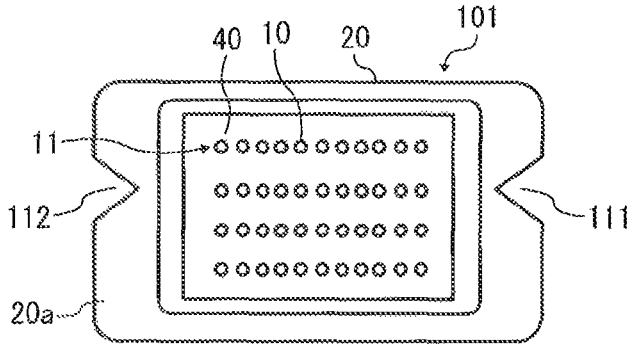
FIG. 3 is a plan view of a head.
Figure 4:
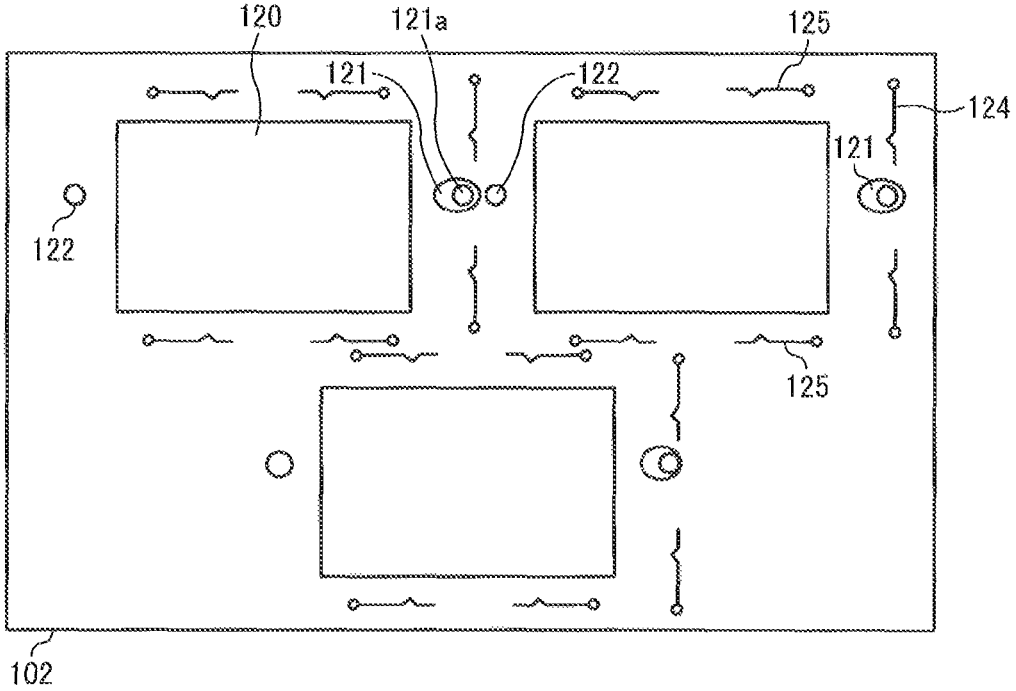
FIG. 4 is a plan view of a head mount.
Figure 5:
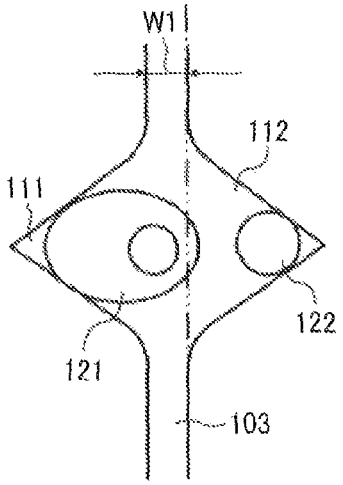
FIG. 5 is an enlarged view of each cutout.

First, with reference to FIGS. 1 to 5, a head unit 100 according to a first embodiment of the present disclosure will be described. FIG. 1 schematically illustrates the head unit 100; FIG. 2 is a front view of the head unit 100 of FIG. 1; FIG. 3 is a plan view of a head 101; FIG. 4 is a plan view of a head mount 102; and FIG. 5 is an enlarged view of each cutout of the head 101.

The head unit 100 includes a plurality of heads 101 (three in the present embodiment), and the head mount 102 on which the plurality of heads or head chips 101 is mounted.

The head 101 includes a nozzle plate 40 on which nozzle arrays 11 are disposed. Each nozzle array 11 includes a plurality of nozzles 10, as a plurality of dot forming elements, and a frame 20.

The plurality of heads 101 is disposed in a staggered manner in a nozzle alignment direction, that is, head alignment direction or X-direction. In this case, adjacent heads 101 are disposed such that at least two nozzles 10 at an edge of the nozzle array 11 in a Y-direction perpendicular to the head alignment direction overlap. As the number of overlapping nozzles increases, a width W1 of a gap 103 between adjacent heads 101 in the head alignment direction narrows.

The head 101 includes V-shaped cutouts 111 and 112 at both ends of the head in the head alignment direction or X-direction. Herein, the cutouts 111 and 112 are disposed on the frame 20.

More specifically, the frame 20 includes a flange 20*a* (see FIG. 3), and the head 101 is mounted to the head mount 102 such that the flange 20*a* is disposed opposite a face of the head mount 102. The cutouts 111 and 112 are in the flange 20*a* of the frame 20.

Between two adjacent heads 101 in the head alignment X-direction, the cutout 111 of one of the heads 101 and the cutout 112 of the other head 101 are disposed opposite each other. As a result, each position of the cutouts 111 and 112 of the head 101 in the Y-direction perpendicular to the head alignment X-direction is the same.

The head mount 102 includes an opening 120, into which a part of the head 101 is inserted, and an eccentric cam 121 and a pin 122 to adjust a tilt position of the head 101. The eccentric cam 121 mounted to the head mount 102 rotates about a shaft 121*a*.

In addition, elastic members 124 to apply pressure to the head 101 toward the pin 122 in the X-direction, and elastic members 125 to apply pressure to the head 101 from both sides in the Y-direction are mounted to the head mount 102.

In one head 101, the eccentric cam 121 contacts one cutout 111, and the pin 122 contacts the other cutout 112. When the eccentric cam 121 is rotated with the head 101 contacted the pin 122 via the elastic member 124, a tilt θ of the head 101 relative to the head alignment direction can be adjusted.

At this time, the eccentric cam 121 is disposed between the cutouts 111 and 112 of the two adjacent heads 101 in the head alignment direction.

With this configuration, even though the width W1 of the gap 103 between two adjacent heads 101 and 101 in the head alignment direction is narrow, the eccentric cam 121 and the pin 122 that serve as a position adjuster can be disposed between two heads 101 and 101.

In addition, because the cutouts 111 and 112 of adjacent two heads 101 and 101 in the head alignment direction are disposed opposite each other, as illustrated in FIG. 5, a part of the eccentric cam 121 disposed in the cutout 111 of one of the heads 101 can be entered into the cutout 112 of the other head 101.

With this structure, the width W1 of the gap 103 between two adjacent heads 101 and 101 in the head alignment direction can be narrowed. By narrowing the width W1 of the gap 103, the number of overlapping nozzles can be increased.

In the state illustrated in FIG. 5, a part of a long axis side of the eccentric cam 121 enters the cutout 112, so that the width W1 can be shorter than the length of the long axis of the eccentric cam 121, that is, a distance between a rotary center and a farthest point of the periphery from the rotary center.

In addition, there is no need of providing the eccentric cam 121 as a position adjuster between the two adjacent heads 101 and 101 in the Y-direction perpendicular to the head alignment direction, and a length L1 of a gap 104 can be narrowed.

With this structure, the head unit 100 can be made more compact.

Figure 6:
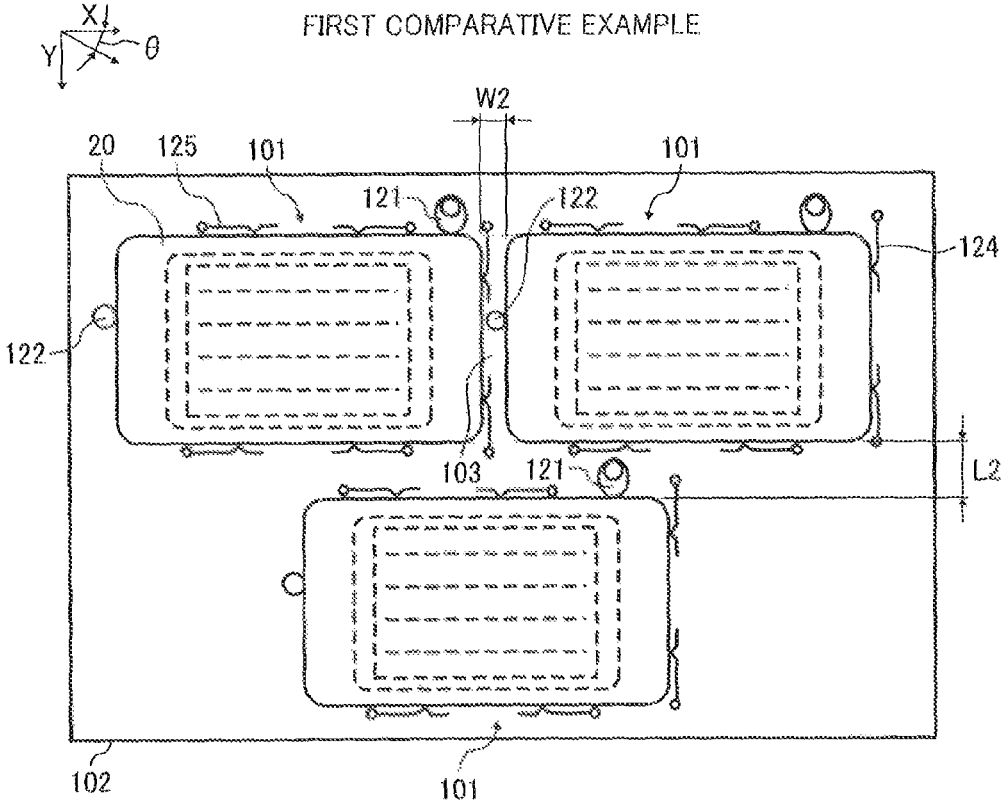
FIG. 6 is a plan view of the head unit according to a first comparative example.

Next, a first comparative example of the head unit 100 will be described with reference to FIG. 6. FIG. 1 is a plan view of the head unit 100.

The head 101 according to the first comparative example does not include cutouts disposed at both ends of the head 101 in the head alignment direction.

In this case, if the eccentric cam 121 serving as the position adjuster moves more than a width W2 of the gap 103 between adjacent heads 101 and 101 in the head alignment direction, the eccentric cam 121 cannot position within the gap 103.

Accordingly, the eccentric cam 121, as a position adjuster, positions at a position to contact a side portion of the head 101 from the Y-direction perpendicular to the head alignment direction. As a result, a length L2 of the gap 104 between adjacent two heads 101 and 101 in the Y-direction perpendicular to the head alignment direction is longer than the length L1 of the gap 104 (L2>L1) according to the embodiment of the present disclosure.

More specifically, a width W2 of the gap 103 between adjacent heads 101 and 101 in the head alignment direction is defined by a size of the outer diameter of the head and the number of nozzles to be overlapped. If the width W2 is narrower than the outer diameter of the pin 122, the pin 122 cannot be disposed.

As a result, the width W2 of the gap 103 should be secured even by decreasing the number of nozzles to be overlapped, and the width W2 of the gap 103 between adjacent heads 101 and 101 in the head alignment direction becomes wider than the width W1 of the gap 103 according to the present embodiment (W2>W1).

On the contrary, according to the present embodiment, because a part or whole of the pin 122 and the eccentric cam 121 disposed in the gap 103 between adjacent heads 101 and 101 in the head alignment direction are entered into the cutouts 112 and 111, the width W1 of the gap 103 can be narrowed. In addition, the eccentric cam 121 need not be disposed in the Y-direction perpendicular to the head alignment direction, so that the length L1 of the gap 104 can also be narrowed.

As a result, the head unit according to the present embodiment can be made more compact than the head unit according to the first comparative example.

Figure 7:
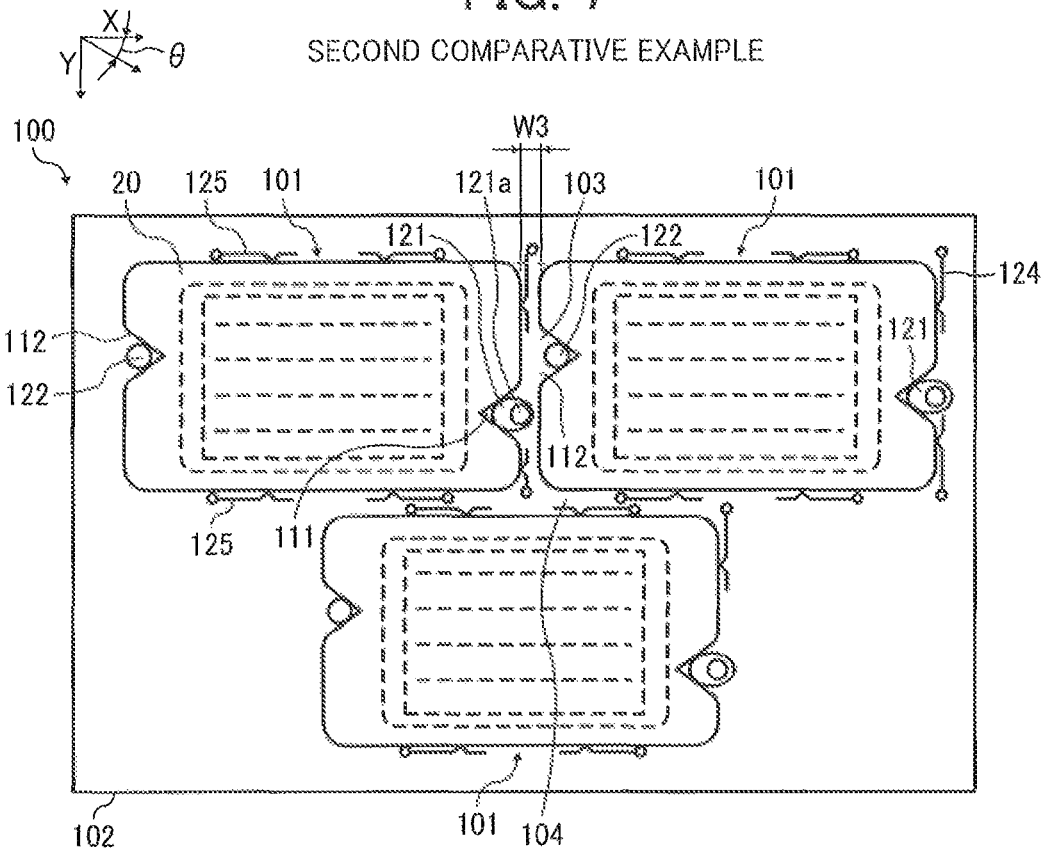
FIG. 7 is a plan view of the head unit according to a second comparative example.

Next, a head unit according to a second comparative example will be described with reference to FIG. 7. FIG. 7 is a plan view of the head unit 100.

The head 101 according to the second comparative example includes cutouts 111 and 112 at both ends of the head 101 in the head alignment direction. However, differently from the present embodiment, the cutouts 111 and 112 are disposed at different positions in the Y-direction perpendicular to the head alignment direction, and the cutout 111 and the cutout 112 are not disposed opposite each other.

In the present structure, the eccentric cam 121 and the pin 122 can be positioned in the cutout 111 and 112.

However, because the cutouts 111 and 112 are not disposed opposite each other, differently from the present embodiment as illustrated in FIG. 5, the eccentric cam 121 to be disposed in the cutout 111 of one of the heads 101 does not enter into the cutout 112 of the other head 101.

As a result, because a width W3 of the gap 103 according to the second comparative example becomes wider than the width W1 of the gap 103 according to the present embodiment (W3>W1), the head unit 100 according to the second comparative example becomes larger than the head unit 100 according to the present embodiment.

Figure 8:
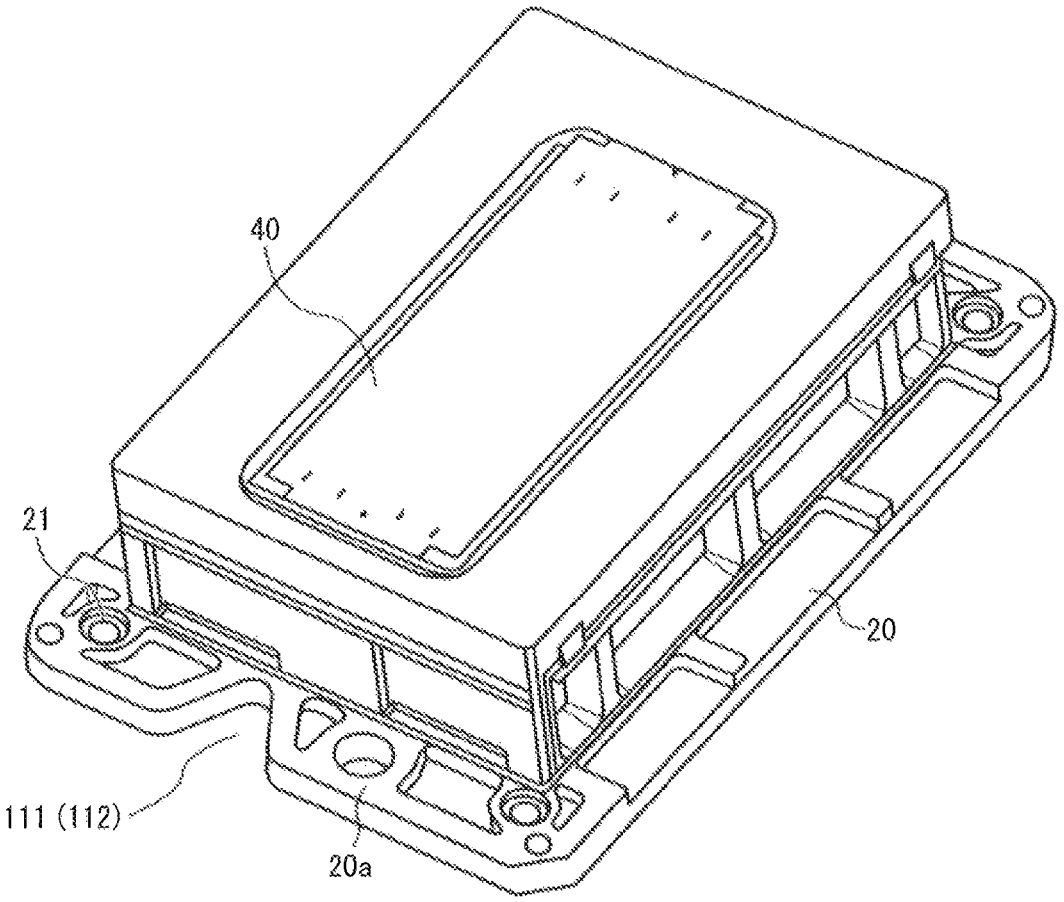
FIG. 8 is a perspective view of an example of the head.

Next, another example of the head 101 will be described with reference to FIG. 8, showing a perspective view of the head.

The head 101, a liquid discharge head, includes, as described above, the nozzle plate 40 on which the nozzle arrays 11 are disposed, and the frame 20, and the cutouts 111 and 112 are disposed at both longitudinal ends of the frame 20, respectively. In addition, a hole 21 to fasten the head 101 to the head mount 102 with fasteners is disposed on the frame 20.

Each of the cutouts 111 and 112 is V-shaped similarly to each other, and an open angle θ is 60 degrees; however, the shape and angle are not limited to above examples.

Next, referring to FIGS. 9 and 10, a position adjuster of the head 101 will be described.

Figure 9:
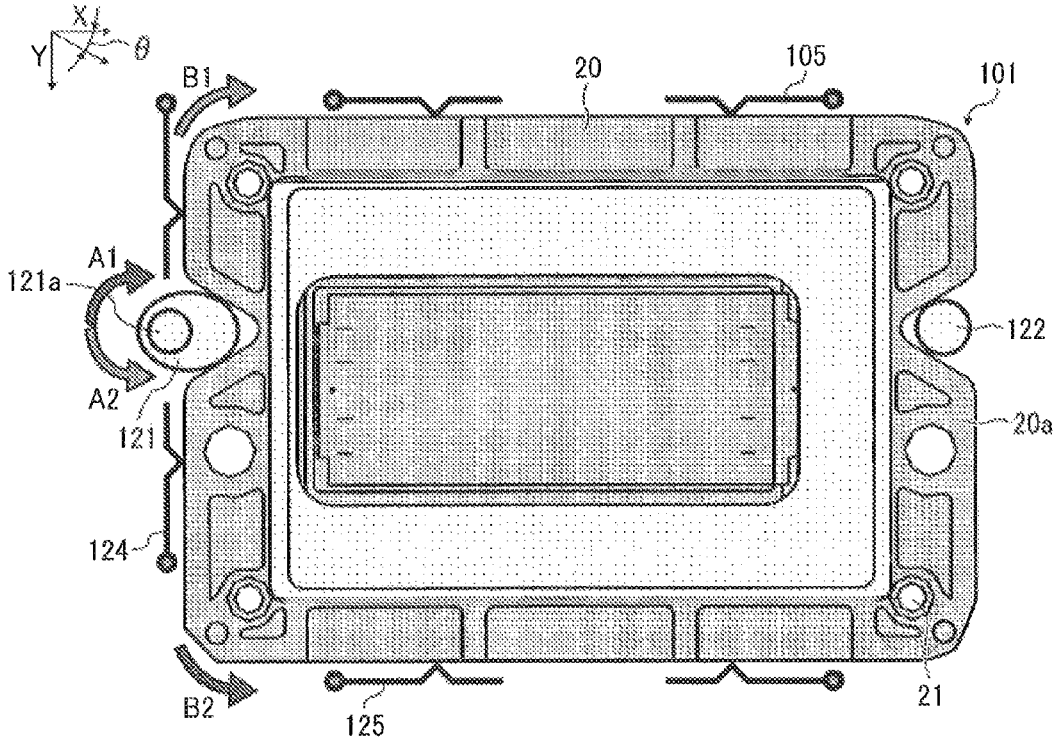
FIG. 9 is a plan view illustrating a position adjuster of the head.
Figure 10:
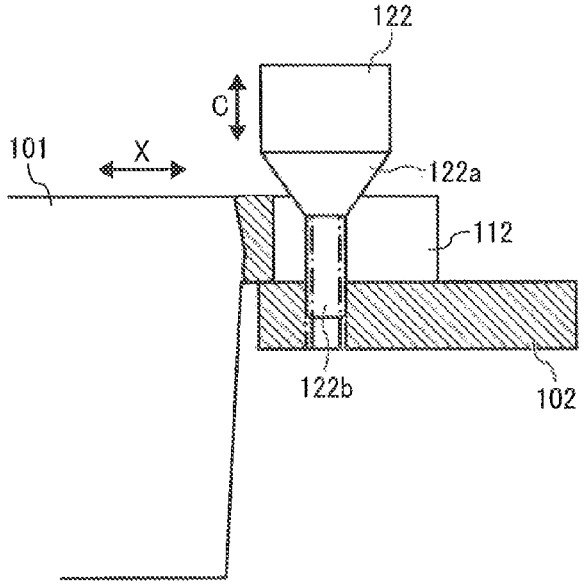
FIG. 10 is a cross-sectional view illustrating a portion of a pin.

FIG. 9 is a plan view of the position adjuster, and FIG. 10 is a cross-sectional view of the pin. It is noted that FIG. 9 is a plan view viewed from the nozzle face, and the head mount is omitted.

The head mount 102 includes the pin 122 that contacts the cutout 112 of the head 101 and the elastic member 124 that applies pressure to the head 101 toward the pin 122.

As illustrated in FIG. 10, the pin 122 is so disposed as to be rotatable and retractable relative to the head mount 102 through a screw 122*b*, and includes a taper portion 122*a* at a portion contacting the wall of the cutout 112.

Accordingly, the pin 122 rotates and moves in the height direction (or arrow C direction) and the head 101 moves in the head alignment direction or X-direction, so that the position of the head 101 in the X-direction can be adjusted.

In addition, the eccentric cam 121 to contact the cutout 111 of the head 101 is disposed to the head mount 102.

When the eccentric cam 121 is rotated in arrow A1 direction or arrow A2 direction, the head 101 rotates in arrow B1 direction or arrow B2 direction about the pin 122, and the tilt of the head 101 in X-Y plane (that is, a position in the θ direction) can be adjusted.

Next, the head unit according to a second embodiment of the present disclosure will be described with reference to FIG. 11.

Figure 11:
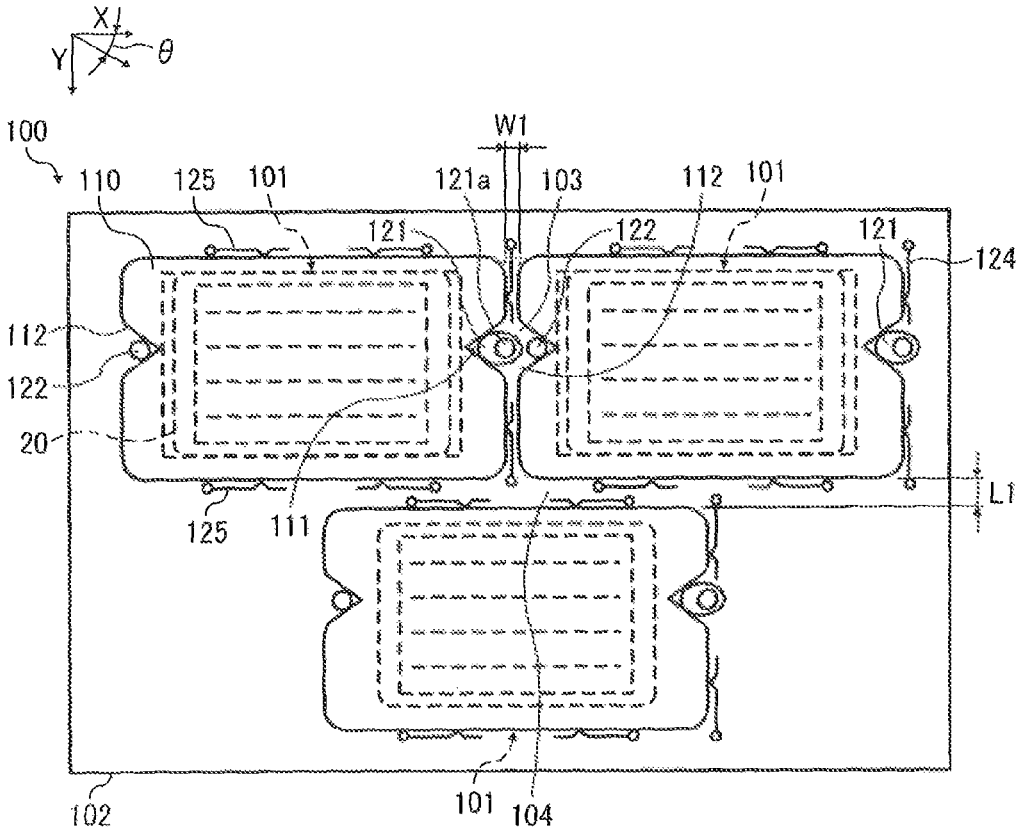
FIG. 11 is a plan view of the head unit according to a second embodiment.

FIG. 11 is a plan view of the head unit according to the second embodiment.

In the second embodiment, the head 101 is mounted to an intermediate member 110, and the intermediate member 110 is mounted to the head mount 102. The intermediate member 110 is intermediary disposed between the head 101 and the head mount 102 and is mounted to both the head 101 and the head mount 102. For example, the intermediate member 110 can be mounted to the frame 20, which is one of the constituents of the head 101, so as to form a flange for the head 101. Then, by securing the intermediate member 110 to the head mount 102, the head 101 can be mounted to the head mount 102.

In the second embodiment, the cutouts 111 and 112 as described in the first embodiment are similarly disposed.

The head mount 102 includes the eccentric cam 121 that contacts the cutout 111 of the intermediate member 110, the pin 122 that contacts the cutout 112, and other elastic members 124 and 125. Even with the above structure, that is, even when the heads once supported by the intermediate member are arranged, the gap between adjacent intermediate members can be narrowed, thereby preventing the head unit 100 from becoming larger.

Figure 12:
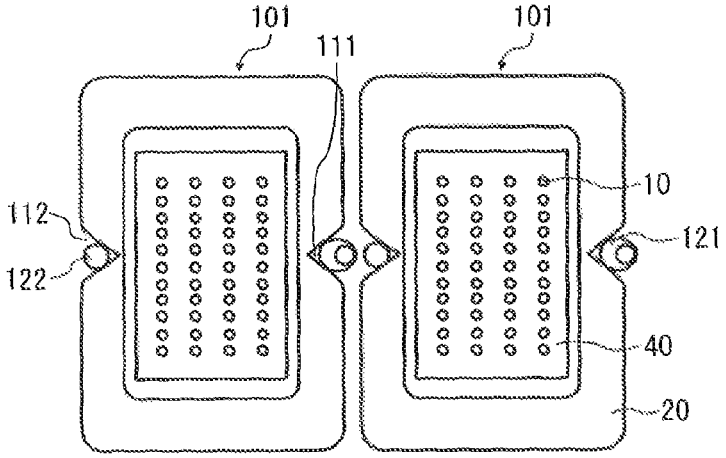
FIG. 12 is a plan view illustrating the head according to a third embodiment.

Next, FIG. 12 illustrates a plan view of the head unit according to a third embodiment.

As illustrated in FIG. 12, in the third embodiment, the heads 101 are arranged with a longer side of the heads 101 adjacent to each other. Each head 101 includes a cutout 111 and a cutout 112 disposed opposite each other in the head alignment direction. The head mount 102 includes the eccentric cam 121 that contacts the cutout 111 of the intermediate member 110, the pin 122 that contacts the cutout 112, and other elastic members 124 and 125. The head mount 102 here serves as a carriage.

With this structure, even when the heads are arranged in the shorter side direction, the gap between the heads can be narrowed and the head unit can be prevented from becoming larger.

Figure 13:
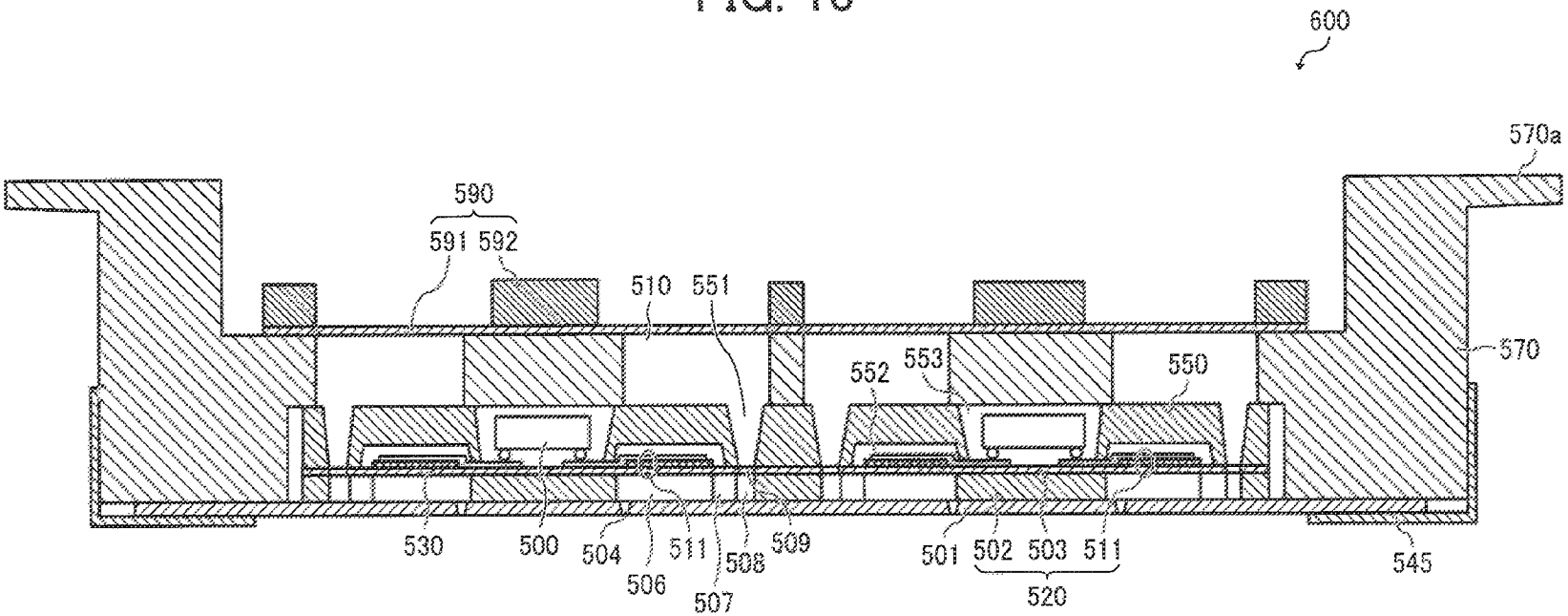
FIG. 13 is a cross-sectional view of an exemplary liquid discharge head that forms the head along a direction perpendicular to a nozzle alignment direction.
Figure 14:
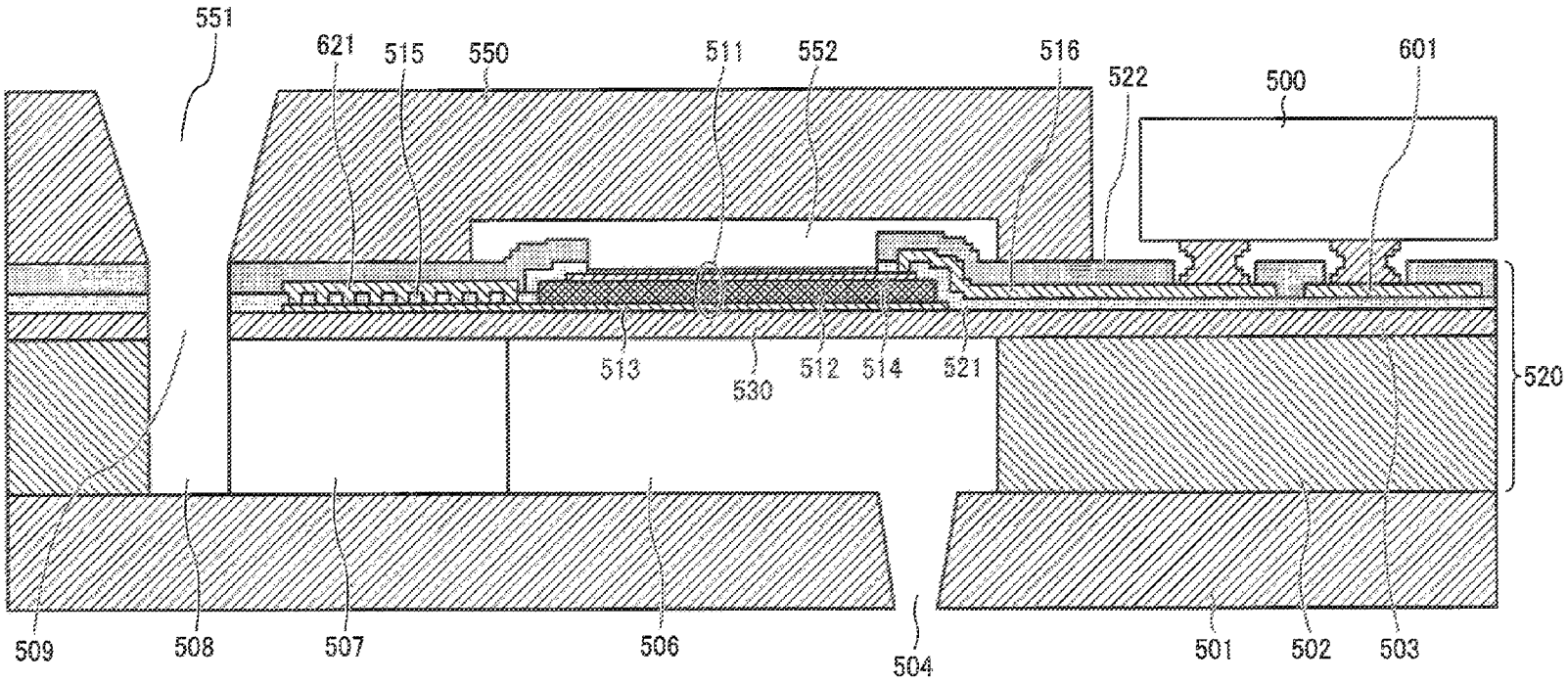
FIG. 14 is an enlarged cross-sectional view illustrating a main part of the liquid discharge head of FIG. 13.
Figure 15:
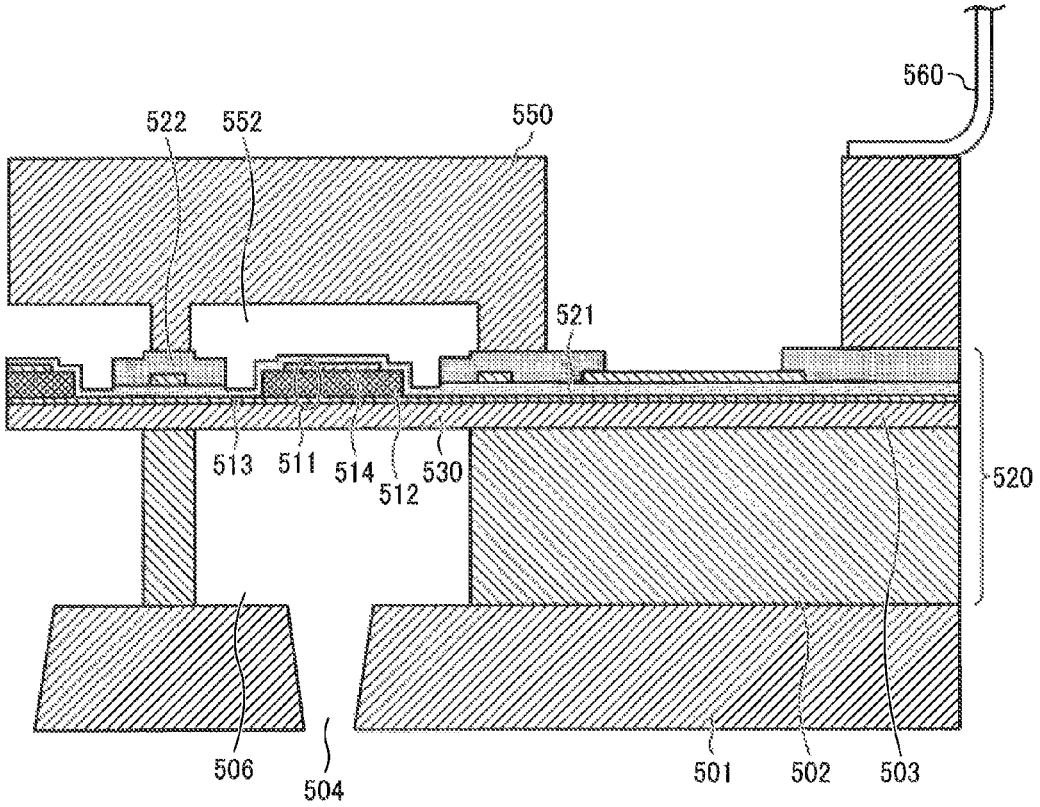
FIG. 15 is also an enlarged cross-sectional view of the main part of the liquid discharge head along the nozzle alignment direction.

Next, referring to FIGS. 13 through 15, one exemplary embodiment of a liquid discharge head forming the head 101 will be described. FIG. 13 is a cross-sectional view of the liquid discharge head 600 along a direction perpendicular to the nozzle alignment direction; FIG. 14 is an enlarged cross-sectional view of a main part of FIG. 13; and FIG. 15 is a cross-sectional view of the liquid discharge head along the nozzle alignment direction.

The liquid discharge head 600 includes a nozzle plate 501 (corresponding to the nozzle plate 40 in FIG. 1); a channel plate 502; a vibration plate 503 being a wall member; a piezoelectric element 511 that generates pressure; a retainer substrate 550; a wire member; and a frame 570 that serves as a common liquid chamber (corresponding to the frame 20 in FIG. 1).

Herein, the channel plate 502, the vibration plate 503, and the piezoelectric element 511 are defined to form an actuator substrate 520. However, after an actuator substrate 520 has been already created independently, the actuator substrate 520 does not further include the nozzle plate 501 and the retainer substrate 550. The channel plate 502 and the vibration plate 503 jointly form a channel member.

A plurality of nozzles 504 (corresponding to the nozzle 10 of FIG. 1) to discharge a liquid is formed to the nozzle plate 501. As illustrated in FIG. 13, four nozzle arrays each of which includes the plurality of nozzles 504 are disposed.

The channel plate 502 together with the nozzle plate 501 and the vibration plate 503 form an individual liquid chamber 506 to which the nozzle 504 communicates, a fluid restrictor 507 communicating to the individual liquid chamber 506, and a liquid inlet or path 508 to which the fluid restrictor 507 communicates.

The liquid inlet 508 communicates, via a path 509 of the vibration plate 503 and an orifice manifold 551 being a channel of a retainer substrate 550, to a common liquid chamber 510 formed of the frame 570.

The vibration plate 503 forms a deformable vibration area 530 that forms part of the wall of the individual liquid chamber 506. A piezoelectric element 511 is disposed integrally with the vibration area 530 on a face opposite the individual liquid chamber 506 of the vibration area 530 of the vibration plate 503, and the vibration area 530 and the piezoelectric element 511 form a piezoelectric actuator.

The piezoelectric element 511 includes a lower electrode 513, a piezoelectric layer 512, and an upper electrode 514 that are sequentially laminated from a side of the vibration area 530. An insulation layer 521 is formed on top of the piezoelectric element 511.

The lower electrode 513 that serves as a common electrode for the plurality of piezoelectric elements 511 is connected, via a common wire 515, to a common electrode power source wire pattern 621. As illustrated in FIG. 15, it is noted that the lower electrode 513 is an electrode layer that straddles all the piezoelectric elements 511 in the nozzle alignment direction.

In addition, the upper electrode 514 that serves as an individual electrode for the piezoelectric element 511, is connected to a driver integrated circuit (IC) 500 via an individual wire 516. The individual wire 516 is coated with an insulation layer 522.

The driver IC 500 is mounted to the actuator substrate 520 by a method such as flipchip bonding so as to cover an area between piezoelectric element arrays.

The driver IC 500 mounted to the actuator substrate 520 is connected to an individual electrode power supply wire pattern 601 that is supplied with drive waveforms (or drive signals).

The wire employed in a wire member 560 is electrically connected to the driver IC 500 and the wire at the other end of the wire member 560 is connected to a controller disposed at the side of the apparatus body.

Then, on the actuator substrate 520, disposed is a retainer substrate 550 where the orifice manifold 551 serving as a path to communicate between the common liquid chamber 510 and the individual liquid chamber 506, a concave portion 552 to accommodate the piezoelectric element 511, and an opening 553 in which the driver IC 500 is accommodated, are formed.

The retainer substrate 550 is connected to the side of the vibration plate 503 of the actuator substrate 520 via an adhesive.

The frame 570 defines the common liquid chamber 510 to supply a liquid to each individual liquid chamber 506. The common liquid chamber 510 is disposed respectively for each of the four nozzle arrays. The liquid with a designated color is supplied to the common liquid chamber 510 via a liquid supply port from outside.

A damper member 590 is bonded to the frame 570. The damper member 590 includes a deformable damper 591 to form part of the wall of the common liquid chamber 510, and a damper plate 592 to reinforce the damper 591.

The frame 570 has a flange 570*a*, is bonded to an outer periphery of the nozzle plate 501 and the retainer substrate 550 with an adhesive, incorporates the actuator substrate 520 and the retainer substrate 550, and structures the frame of the liquid discharge head 600.

Also, a nozzle cover 545 to cover a peripheral portion of the nozzle plate 501 and part of the outer periphery of the frame 570 is disposed.

The liquid discharge head 600 is configured to apply voltage to a portion between the upper electrode 514 and the lower electrode 513 of the piezoelectric element 511 from the driver IC 500, to thereby cause the piezoelectric layer 512 to expand in an electrode lamination direction, that is, in the electric field direction and shrink in a direction parallel to the vibration area 530.

In this case, because the lower electrode 513 is detained by the vibration area 530, a tensile stress is generated to the lower electrode 513 of the vibration area 530, and the vibration area 530 bends to the side of the individual liquid chamber 506 and applies pressure to the liquid inside, and thus the liquid is discharged from the nozzle 504.

In the above embodiments, the head is a liquid discharge head, but is not limited to this.

Figure 16:
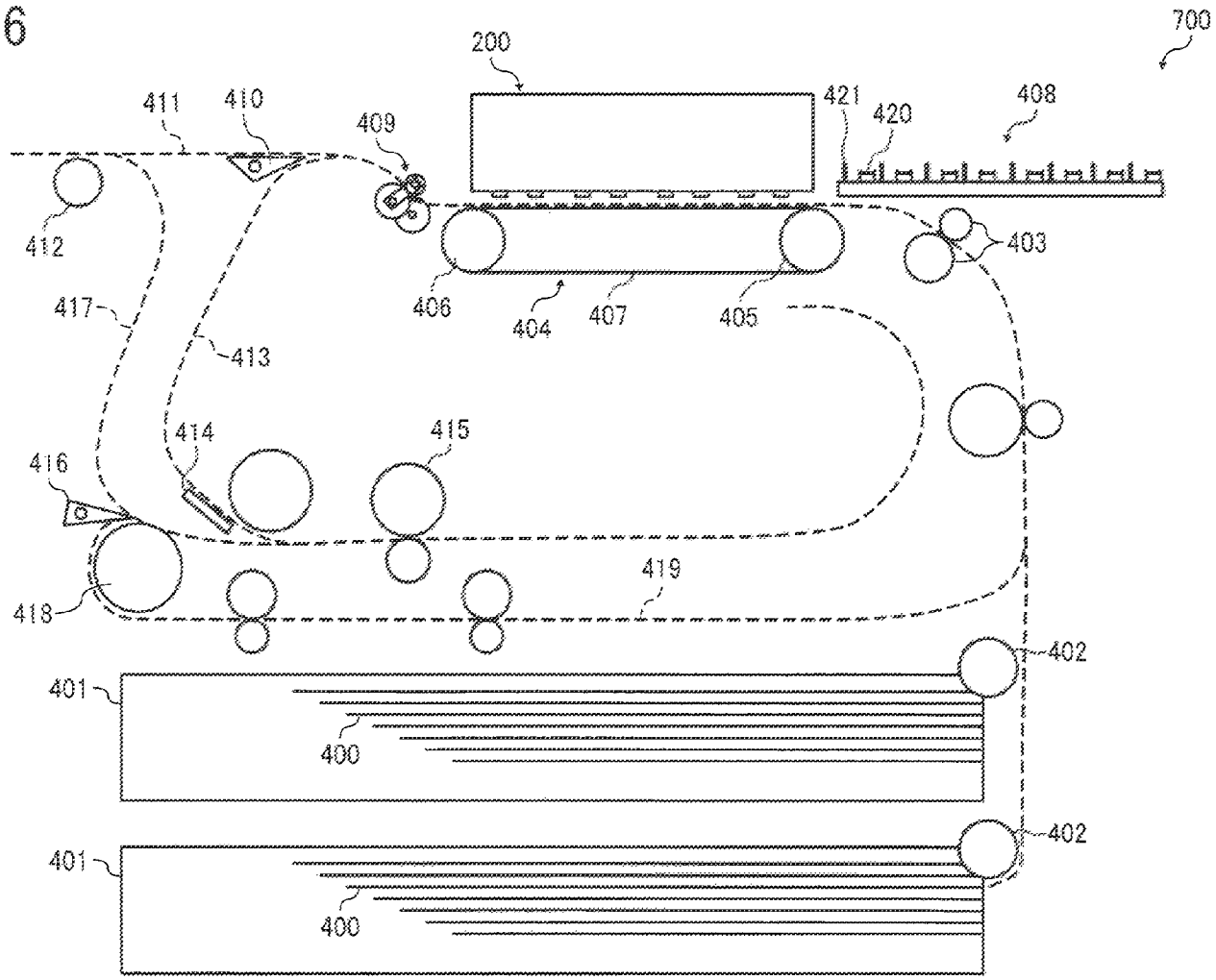
FIG. 16 illustrates an example of a liquid discharge apparatus according to the present disclosure.
Figure 17:
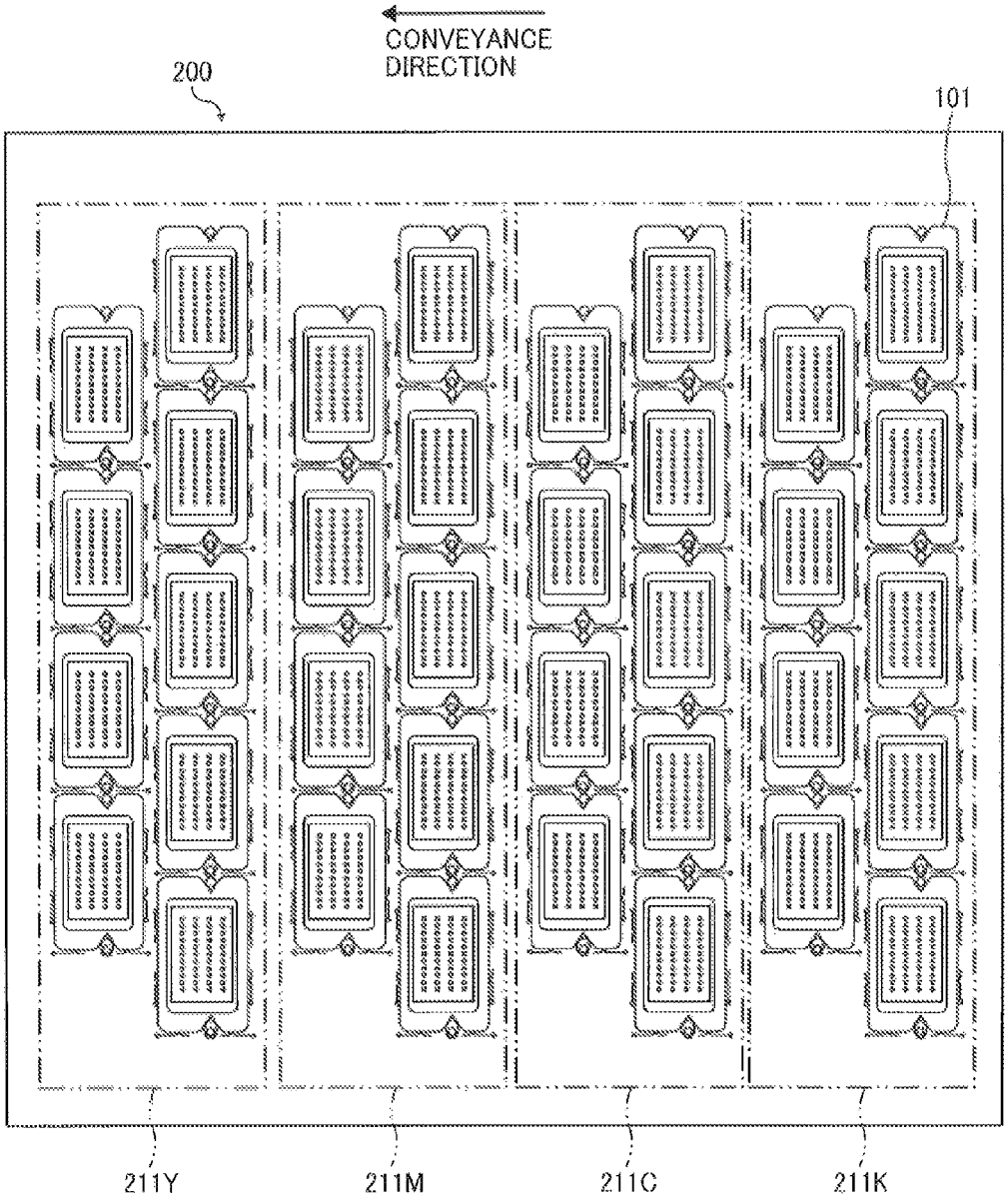
FIG. 17 is a plan view of the liquid discharge unit of the liquid discharge apparatus of FIG. 16.

Next, an exemplary apparatus to discharge liquid is explained with reference to FIGS. 16 and 17. FIG. 16 illustrates the liquid discharge apparatus 700 and FIG. 17 is a plan view of a liquid discharge unit 200.

The liquid discharge apparatus includes sheet trays 401 in which sheet material 400 is stacked, a liquid discharge unit 200 to discharge liquid to the sheet material 400, and a conveyance unit 404 disposed opposite the liquid discharge unit 200, to convey the sheet material 400.

The sheet material 400 stacked inside each of the sheet trays 401 is conveyed by a sheet feed roller 402 along a conveyance path indicated by a broken line. The sheet material 400 conveyed to the conveyance path passes through a thin-adjustment and skew-correction roller pair 403, that is, a so-called registration roller pair, and is conveyed to the conveyance unit 404.

The conveyance unit 404 includes a conveyance roller 405 driven at a predetermined timing, a tension roller 406 and an endless conveyance belt 407 stretched around these rollers 405 and 406.

In addition, it is noted that electrostatic absorption method, air absorption method, and other known method may be used to hold the sheet material 400 via the conveyance belt 407 of the conveyance unit 404.

The conveyance unit 404 conveys the sheet material 400 to oppose to the liquid discharge unit 200, and the liquid is discharged from the liquid discharge unit 200 to the sheet material 400 corresponding to image data. As a result, an image is formed on the sheet material 400.

The liquid discharge unit 200 includes liquid head units 211K, 211C, 211M, and 211Y, each of which is formed of the plurality of head units 100 according to the first embodiment. The liquid head units 211K, 211C, 211M, and 211Y discharge a liquid of black (K), cyan (C), magenta (M), and yellow (Y), respectively.

The sheet material 400 on which the image is formed by the liquid discharge unit 200 is conveyed to a decurler unit 409, where the sheet material 400 is decurled or is subject to the curl correction.

The sheet material 400 that has passed through the decurler unit 409 passes through a conveyance path 411 via a separation claw 410, is conveyed to an ejection roller 412, and is discharged outside.

Alternatively, in the reverse ejection mode or duplex printing mode, the separation claw 410 is switched from a position as illustrated in FIG. 16 to a counterclockwise direction, and the sheet material 400 passes through a conveyance path 413, and is conveyed to a beat roller 415 via a guide 414. The sheet material 400 that has conveyed to the beat roller 415, is conveyed in a reverse direction by the beat roller 415 that has changed a rotary direction.

In the reverse ejection mode, the sheet material 400 passes through a second separation claw 416, further passes through a conveyance path 417, is conveyed to the ejection roller 412, and is ejected outside.

When printing is performed on a back of the sheet material 400 in the duplex printing mode, the sheet material 400 conveyed in the reverse direction by the beat roller 415, passes through a portion between the second separation claw 416 that has changed from the position illustrated in FIG. 16 to the counterclockwise direction and a duplex reverse roller 418, passes through a conveyance path 419, and is sent to the registration roller pair 403.

A recovery unit 408 to maintain and recover properties of each head 101 of the head unit 100 of the liquid discharge unit 200 is further disposed. The recovery unit 408 includes a cap 420 to cap a nozzle face of each head 101 of the liquid discharge unit 200, a suction pump connected to the cap 420, and a wiper 421 to wipe the liquid remaining on the head when the liquid is sucked inside the cap 420.

When the maintenance and recovery operation is performed, the liquid discharge unit 200 elevates, the recovery unit 408 moves below the liquid discharge unit 200, and the maintenance and recovery operation is performed. The cap 420 of the recovery unit 408 serves as a moisturizing cap to retain moisture of each head 101 of the liquid discharge unit 200. When the printing is not performed, the liquid discharge unit 200 is elevated, and the recovery unit 408 moves below the liquid discharge unit 200, to thereby perform moisturizing capping.

In the present embodiments as described above, a "liquid discharge apparatus" includes a liquid discharge unit and a liquid discharge head, and discharges a liquid while driving the liquid discharge head. The liquid discharge apparatus includes not only a device to discharge a liquid to a certain material on which the liquid can be adhered but a device to discharge a liquid to air or the liquid.

The "liquid discharge apparatus" may include means to feed, convey, and eject the material on which the liquid can be adhered, and otherwise include a pre-treatment device and a post-treatment device.

For example, the liquid discharge apparatus is not limited to a device to visualize an image having a meaning such as letters and figures via the discharged liquid. Alternatively, the liquid discharge apparatus may include a device to form patterns without a meaning in itself, and a device to generate a three-dimensional image.

The "material to which the liquid can adhere" means the material on which the liquid may at least temporarily adhere, the material on which the liquid adheres and is attached firmly, and the material on which the liquid adheres and permeates. Examples may include recorded media such as a sheet, a recording sheet, a film, and cloth; electronic parts such as an electronic board, and a piezoelectric element and other media such as a powder layer, body part model, and inspection cell; and further includes all materials to which the liquid may adhere, unless not limited in particular.

The "material to which the liquid can adhere" may include any materials, to which the liquid may adhere even temporarily, such as paper, thread, fiber, cloth, leather, metal, plastic, glass, wood, ceramics, and the like.

In addition, the term "liquid" may include ink, treatment liquid, DNA sample, resist, pattern material, bonding agent, molding liquid, and solution and dispersion liquid including amino acid, protein, and calcium.

In addition, the "liquid discharge apparatus" includes a type of device in which the liquid discharge head and the material to which the liquid can adhere move relatively, but is not limited to this. More specifically, included are a serial-type device in which the liquid discharge head moves and a line-type device in which the liquid discharge head does not move.

In addition, the "liquid discharge apparatus" also includes a treatment liquid coating device to discharge a treatment liquid on a sheet for coating the treatment liquid on a surface of the sheet to, for example, improve the surface of the sheet. The liquid discharge apparatus further includes an injection granulation device to granulate minute particles as raw materials by injecting a composition liquid in which raw materials are dispersed into the solution, via the nozzle.

Additional modifications and variations of the present disclosure are possible in light of the above teachings. It is therefore to be understood that, within the scope of the appended claims, the disclosure may be practiced other than as specifically described herein.

What is claimed is:

1. A head unit comprising:

a plurality of heads; and a head mount on which the plurality of heads is arrayed, wherein the head mount includes a plurality of position adjusters to adjust positions of the plurality of heads, wherein each head amongst the plurality of heads includes a cutout, for at least one end of the head in a head alignment direction, and wherein at least one position adjuster amongst the plurality of position adjusters is disposed inside at least one cutout amongst opposed cutouts of respective adjacent heads, the opposed cutouts being opposed to each other.

2. The head unit according to claim 1, wherein the at least one position adjuster is disposed in contact with the at least one cutout amongst the opposed cutouts of the adjacent heads.

3. The head unit according to claim 1, wherein the plurality of heads is disposed in a staggered manner.

4. The head unit according to claim 1, wherein the position adjuster includes an eccentric cam.

5. The head unit according to claim 4, wherein a width of a gap between the adjacent heads in the head alignment direction is shorter than a length of a long axis of the eccentric cam.

6. The head unit according to claim 1, wherein each of the plurality of heads is a liquid discharge head, and wherein each of the plurality of heads includes:

a frame; and a nozzle plate including a plurality of nozzle arrays each having a plurality of nozzles to discharge a liquid;

wherein the frame includes a flange on a peripheral surface of the frame, and wherein the cutouts of each of the plurality of heads are disposed at both ends of the flange in the head alignment direction.

7. A liquid discharge apparatus comprising the head unit according to claim 1 to discharge a liquid.

8. A head unit comprising:

a plurality of heads;

a plurality of intermediate members to hold the plurality of heads; and a head mount on which the plurality of heads is arrayed, wherein the head mount includes a plurality of position adjusters to adjust positions each of the plurality of heads, wherein each intermediate member amongst the plurality of intermediate members includes a cutout, for at least one end of the intermediate member in a head alignment direction, and wherein at least one position adjuster amongst the plurality of position adjusters is disposed inside at least one cutout amongst opposed cutouts of respective adjacent intermediate members, the opposed cutouts being opposed to each other.

9. The head unit according to claim 8, wherein each of the plurality of heads is a liquid discharge head to discharge a liquid.

10. A liquid discharge apparatus comprising the head unit according to claim 9 to discharge the liquid.

* * * * *